United States Patent [19]

Takahashi

[11] 4,179,290

[45] Dec. 18, 1979

[54] PHOTOELECTROPHORETIC PHOTOGRAPHY PROCESS INVOLVING DUAL CORONA TREATMENTS OF OPPOSITE POLARITY

[75] Inventor: Isoji Takahashi, Asaka, Japan

[73] Assignee: Fuji Photo Film Co., Ltd., Minami-ashigara, Japan

[21] Appl. No.: 884,507

[22] Filed: Mar. 8, 1978

[30] Foreign Application Priority Data

Mar. 14, 1977 [JP] Japan ..... 52-28321

[51] Int. Cl.[2] ..... G03G 13/22

[52] U.S. Cl. ..... 430/34; 355/3 P; 430/35

[58] Field of Search ..... 96/1 PE, 1 C, 1 LY; 355/3 P

[56] References Cited

U.S. PATENT DOCUMENTS

| | | | |
|---|---|---|---|
| 3,510,419 | 5/1970 | Carreira | 96/1 PE |
| 3,609,031 | 9/1971 | Kinoshita | 96/1 C |
| 3,775,104 | 11/1973 | Matsumoto et al. | 96/1 C |

*Primary Examiner*—John D. Welsh

*Attorney, Agent, or Firm*—Sughrue, Rothwell, Mion, Zinn and Macpeak

[57] ABSTRACT

A photoelectrophoretic image-forming process utilizing a pair of electrodes with at least one of the electrodes being transparent and at least one of the electrodes having an electrically insulating surface, which comprises the following steps of:

(1) forming a liquid film which comprises a suspension of light-sensitive particles in an electrically insulating carrier liquid on the electrically insulating surface of one of the electrodes (hereinafter called the first electrode), (2) in a first showering, showering the liquid film with corona ions of either a positive polarity or a negative polarity to form an electrically charged liquid film, (3) in a further showering, showering the electrically charged liquid film with corona ions containing corona ions of a polarity opposite to the polarity of the corona ions showered in the first showering, (4) positioning the other electrode (the second electrode) facing the first electrode with the liquid film therebetween, (5) image-wise exposing the liquid film through the transparent electrode while simultaneously applying an electrical potential across both electrodes such that the polarity of the second electrode is the same as the polarity of the corona ions showered in the first showering and thereby, causing image-wise exposed light-sensitive particles in the liquid film to migrate from the first electrode onto the surface of the second electrode and form an image of the light-sensitive particles on at least one of the electrodes.

21 Claims, 3 Drawing Figures

PHOTOELECTROPHORETIC PHOTOGRAPHY PROCESS INVOLVING DUAL CORONA TREATMENTS OF OPPOSITE POLARITY

BACKGROUND OF THE INVENTION

1. Field of the Invention

The present invention relates to photoelectrophoretic photography and, particularly, to an improved process for producing images by utilizing a photoelectrophoretic photographic technique in which an injection electrode having an electrically insulating layer is used.

2. Description of the Prior Art

The photoelectrophoretic photographic process is well-known, e.g., as described in U.S. Pat. No. 3,384,565, U.S. Pat. No. 3,510,419 (corresponding to Japanese Patent Publication No. 21781/68), etc. and comprises the following steps of: (1) sandwiching an electrically insulating liquid containing light-sensitive, electrically charged particles (hereinafter referred to as an "ink") between a pair of electrodes at least one of which is partially transparent to light and (2) image-wise exposing the ink to light through the transparent electrode while simultaneously applying an electrical potential across both electrodes to cause the above-described charged particles to migrate in an image-wise pattern, wherein either or both of the particles remaining on the above-described transparent electrode through which they were image-wise exposed or/and the particles held firmly on the opposing electrode to the above-described transparent electrode through migration produce image(s). Such a process is described in detail in, for example, U.S. Pat. No. 3,510,419 (corresponding to Japanese Patent Publication No. 21781/68).

In photoelectrophoretic photography as described above, one of the pair of electrodes is called an injection electrode and the other of the electrodes is called a blocking electrode. The injection electrode corresponds to the electrode to which the charged particles present in the ink adhere upon exposure to the action of an electric field in the dark, which electrode has a polarity opposite that of the electric charge which the charged particles possess in the dark. On the other hand, the blocking electrode corresponds to the electrode toward which the optically-exposed particles migrate due to the influence of an electric field to be held thereon. This blocking electrode has the same polarity as that of the electric charge which the charged particles possess in the dark.

In many ordinary cases, the injection electrode has an electrically conductive surface, while the blocking electrode has an electrically insulating surface. However, electrodes where this situation is reversed may be also employed. Generally speaking, in conventional cases, these electrodes may possess any electrical properties at the surfaces thereof. Such being the case, only in particular situations are the electrical properties to be possessed by the surface of each electrode specified in advance. For instance, it is desirable for the injection electrode to have an electrically insulating surface when the blocking electrode has an electrically conductive surface.

An improved process in the art of photoelectrophoretic photography is disclosed in, for example, British Pat. No. 1,331,622, where an attempt was made to discover some way for causing all of the charged particles in the ink to have the same polarity and to control the deterioration in image quality resulting from a flow of the ink in the image-forming process. More specifically, in this process an image-wise exposure to light through a transparent electrode and an application of a voltage of a proper magnitude across a pair of electrodes are carried out simultaneously to thereby cause an image-wise distribution in the migration of charged particles. In this improved process corona ions having the same polarity as the polarity present at the blocking electrode due to the source of electric potential applied across the pair of electrodes in the subsequent image-forming process are showered on the ink coated on the surface of the injection electrode and, then, the resulting ink is sandwiched between the injection and the blocking electrodes, and exposed simultaneously to the action of an electric field and radiant energy in an image-wise pattern.

However, this process has proved to be effective only for the above-described purposes, and has been found to possess the following disadvantage in addition. Where the surface of the injection electrode is electrically insulating, corona ions of the same polarity as the polarity of the blocking electrode, to which an electric potential is to be applied in the subsequent image-forming process, accumulate on the electrically insulating surface of the injection electrode causing the electrically insulating surface to become charged and consequently, an electric field created by corona ions accumulating on the electrically insulating surface greatly weakens the effectiveness of the electric field to be applied to the charged particles incorporated in the ink in the subsequent image-forming process.

Accordingly, even though the charged particles in the ink are activated optically, an image can not be formed or only a poor image can be formed in this process as described above, because it is difficult to apply an electric field of the strength necessary to force the charged particles to migrate through the ink.

In order to eliminate the above-described defect and to thereby produce images of good quality, a powerful source of electric potential which can drown the electric field created by the corona ions accumulating on the electrically insulating surface and, further, which can generate in the particles an electric field sufficiently high that the optically-activated particles are forced to migrate must be connected between both the injection and the blocking electrodes.

Application of an electric field of such a high level across the injection and the blocking electrodes requires the space between the injection electrode and the blocking electrode to be insulated, and the insulation of a material to be grounded must be good enough to withstand the electric field applied. Therefore, a large-size apparatus is required for achieving such a high degree of insulation, which is costly. In addition, air tends to be ionized by sparks generated upon separating one electrode from the other electrode after the image-formation, which tends to cause a deterioration in the quality of images.

SUMMARY OF THE INVENTION

Therefore, an object of the present invention is to provide a photoelectrophoretic photographic process using an injection electrode having an electrically insulating surface in which the above-described disadvantages inherent in the improved process described in British Pat. No. 1,331,622 can be removed therefrom.

Namely, the above-described object is attained by showering the ink covering the electrically insulating surface of an injection electrode first with corona ions of the same polarity as the blocking electrode, the polarity of which is determined by the electric potential to be applied thereto in the subsequent image-forming process, and sequentially, showering the ink with corona ions of a polarity opposite to the first coronoa ions showered, followed by the image-forming process. Therein, the electrical sign of the charged particles present in the ink can be rendered the same as the polarity of the first corona ions by the first showering of the corona ions, the electric charge produced by the corona ions accumulated on the electrically insulating surface of the injection electrode can be reduced or counteracted by the second showering of corona ions and thereby, in the subsequent image-forming process, an image of good quality can be obtained without increasing the electric potential applied across both the injection and the blocking electrodes.

That is to say, the present invention provides an image-forming process utilizing photoelectrophoretic photography employing a pair of electrodes, at least of which is transparent and, at least one of which has an electrically insulating surface, wherein the process comprises forming a liquid film comprising a suspension containing light-sensitive particles on the electrically insulating surface of one of the electrodes (the first electrode), first showering the liquid film with corona ions of either polarity and successively, showering the liquid film with corona ions containing corona ions having a polarity opposite the polarity of the first corona ions and then, positioning the other electrode (the second electrode) facing the first electrode with the liquid film therebetween, applying an electric potential across the two electrodes such that the polarity of the second electrode is the same as the polarity of the corona ions of the first showering while simultaneously irradiating the liquid film with light in an image-wise pattern through the transparent electrode to allow the light-sensitive particles present in optically-exposed areas of the liquid film to move from the surface of the first electrode toward the surface of the second electrode and to thereby produce an image of the light-sensitive particles on at least one of the electrodes.

DETAILED DESCRIPTION OF THE INVENTION

The second corona ion showering can be carried out using a corona charging device generating alternatively corona ions of the same polarity as the corona ions first showered and corona ions of a polarity opposite to that of the corona ions first showered; i.e., a so-called alternating corotron. Also, a D.C. corotron and a D.C. scorotron generating corona ions of the opposite polarity to the corona ions first showered can be used. These corona ion producing devices are well-known in the art, as described in, for example, Dessuer, Motto and Bogdonoff, *Photographic Engineering*, vol. 6, No. 4, pp 253 (1955). In addition, a charging device having a construction where a superimposed voltage supplied by a combination of a D.C. electric potential source and an A.C. potential source can be applied across corona electrodes may be also employed. Furthermore, it is possible to use as the corona ion source for the second showering other known corona charging devices if they can generate corona ions containing corona ions of a polarity opposite to that of the corona ions first showered.

Corona ions showered onto the ink in the second corona showering according to the present invention preferably are showered in a quantity insufficient to cause an inversion in the polarity of the charged particles in the ink which has been formed in the first corona charging. However, this restriction does not apply to a blocking electrode of the kind which is capable of inverting the polarity of charged particles adhering to the blocking electrode in an optically-unexposed area, which is a polarity opposite to the corona ions first showered, and forcing them migrate to the injection electrode and, on the other hand, which is not capable of re-inverting the polarity of charged particles in the optically-exposed area, which is the same as the corona ions first showered by inversion through exposure to light, or can induce only a slight re-inversion in their polarity. More specifically, the restriction does not apply to a blocking electrode having a dark electric charge-injecting property. Specific examples of such a blocking electrode include those which possess an electrically conductive surface or a semi-conductive surface. The term "electrically conductive surface" as used herein means a surface having a specific resistance of about $10^8\Omega\cdot$cm or less and the term "semi-conductive surface" as used herein means a surface having a specific resistance of about $10^8\Omega\cdot$cm to about $10^{12}\Omega\cdot$cm.

Figure 1:
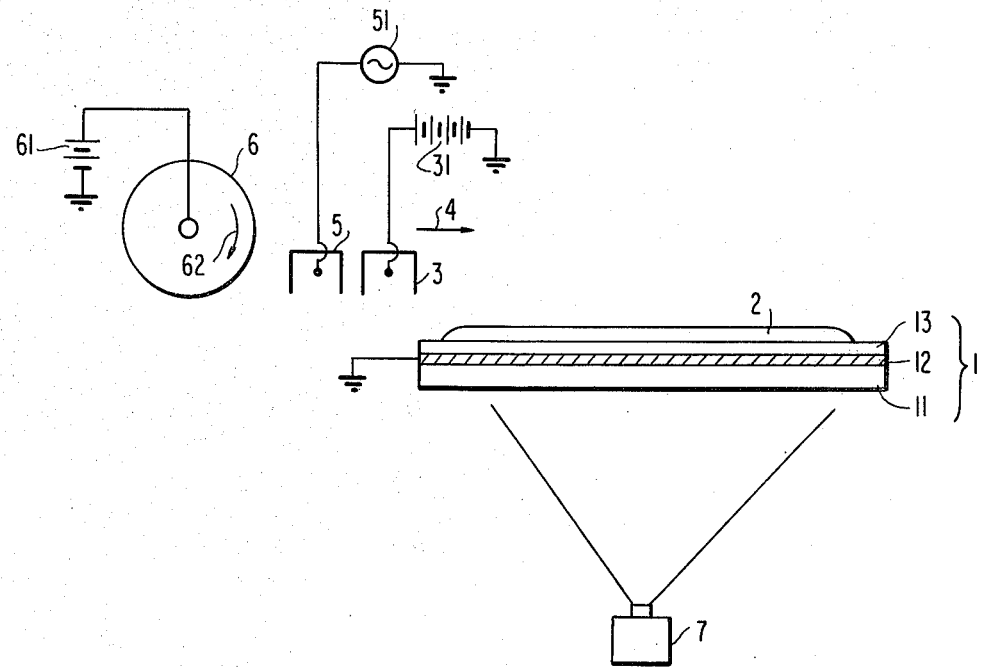
FIG. 1 is a schematic cross-sectional diagram of an apparatus useful in carrying out the process of the present invention.

The present invention will be illustrated in greater detail by referring to the drawings and in particular to FIG. 1, in which one embodiment of an apparatus useful in carrying out the novel photoelectrophoretic image-forming process of the invention is depicted schematically using a cross sectional diagram.

An injection electrode 1 comprises a transparent base plate 11, a grounded transparent electrically conductive layer 12 and a transparent electrically insulating layer 13. Also, the term "electrically conductive" as used herein means a surface resistance of about $10^8\Omega$/square or less and the term "electrically insulating" as used herein means a surface resistance of about $10^{12}\Omega$/square or higher.

Ink 2 is then coated on the surface of the electrically insulating layer 13 of injection electrode 1 using an appropriate coating technique. Ink 2 contains light-sensitive charged particles in an electrically insulating carrier liquid.

The type of light sources which can be used in this invention for the image-wise exposure, of course, will be dependent upon the wavelength region to which the light-sensitive particles present in the liquid film are sensitive. If the light-sensitive particles are sensitive to ultraviolet light, light sources capable of generating light containing ultraviolet light can be used. Further, if the light-sensitive particles are sensitive to visible light, then light sources capable of generating light containing visible light can be used. Conventional light sources capable of generating ultraviolet light and/or visible light can be easily selected by one skilled in the art.

The term "light-sensitive" as used herein in the phrase "light-sensitive charged particles" means that the sign of the electric charge of the particles is inverted when the particles are exposed to light under the action of an electric field of an appropriate magnitude and the particles are made to migrate by the electric field, as defined in Japanese Patent Publication No. 21781/68. Further with respect to the transparent electrode as used herein, the degree of transparency is not limiting. It is sufficient for the transparency to be such that, when light is irradiated through the transparent electrode while applying an electric potential between both electrodes onto the liquid film containing the light-sensitive particles, the polarity of the light-sensitive particles at the exposed area in the liquid film is changed to the opposite polarity. More specifically, in general a sufficient transparency exists if at least about 10%, preferably 30%, or more light in the wavelength region to which the light-sensitive particles are sensitive is passed.

The corona charging device 3 for the first showering comprises a corona electrode and a shield, in which the corona electrode is connected to the positive side of a source of D.C. electric potential 31. The charging device 3 moves in the direction of the arrow 4 while showering positive corona ions on ink 2. At this time, all of the charged particles in the ink have an electric charge of a positive polarity and are firmly held on the surface of the electrically insulating layer 13. The corona ions first showered not only adhere to the charged particles in the ink but also accumulate on the surface of the electrically insulating layer 13.

The corona voltage applied by the first D.C. power supply 31 ranges from about 4 kV to about 8 kV. The electric potential created by the corona ions first showered accumulated on the surface of the electrically insulating layer 13 depends upon the dielectric constant and the thickness of the electrically insulating layer 13, and the distance between the corona charging device 3 used in the first showering and the surface of the electrically insulating layer 13, but, in general, it ranges up to several hundreds to several thousands of volts.

Next, the corona charging device 5 used in the second showering is moved in direction of the arrow 4 while showering ink 2 with corona ions containing both corona ions of a positive polarity and corona ions of a negative polarity. The corona electrode in the corona charging device 5 for the second showering is connected to an A.C. high voltage power supply 51. The A.C. high voltage power supply 51 can provide a desirable result when a voltage of about 3 to about 12 kilovolts oscillating with a frequency ranging from about 10 Hz to about 100 kHz is generated. The shape of the A.C. voltage can be that of a sine wave, a rectangular wave, a sawtoothed wave or other generally known wave shapes can be employed herein. A power supply oscillating to produce a sine wave with a frequency of 50 Hz or 60 Hz is particularly advantageous because of its low price.

The corona ions accumulated on the surface of the electrically insulating layer 13 can be counteracted by the showering with the corona ions in the second showering described above to reduce or eliminate the surface potential. It might also be thought that the corona ions in the second showering reduce, at the same time, the quantity of electric charge held by each of the particles in the ink adhering to the surface of the electrically insulating layer 13, but it has been experimentally confirmed that such a reduction in the electric charge is substantially negligible in practice.

Reference numeral 6 is a blocking roller electrode, the electrically conductive part of which is connected to a source of D.C. potential 61 on the side of a positive polarity as shown in the figure; i.e., the same polarity as the corona ions first showered. The blocking roller electrode 6 travels in the direction of the arrow 4 while simultaneously rotating in the direction of the arrow 62 after the second corona charging is finished. As a result of this motion of the blocking roller electrode 6 over almost the entire area of the injection electrode 1, a transient sandwich is formed between them. Simultaneously with the start of this motion of the blocking roller electrode 6, exposure to an image-wise pattern of light is started using a light source 7. Consequently, the optically-exposed particles whose polarity has been inverted move toward the blocking electrode and are held thereon. Thus, an image is formed on the blocking electrode 6. On the other hand, the particles remaining on the injection electrode 1, which are not driven toward the blocking electrode 6 also form another image on the injection electrode.

Images of good quality can be produced when an electric potential of a magnitude almost equal to or a slightly larger than, e.g., about 20% higher than, that of the potential applied in a conventionally carried-out photoelectrophoretic photographic process in which the first corona charging is not employed (e.g., a process as is described in Japanese Patent Publication No. 21781/68) is applied to the blocking electrode 6. Specifically, the appropriate magnitude of the electric potential to be applied thereto depends upon the kind of light-sensitive particles, the kind of blocking electrode, the kind and the thickness of the electrically insulating layer provided on the injection electrode and so on, but a voltage ranging from about 300 volts to about 6,000 volts can be used to produce images of good quality. On the other hand, where the first corona charging alone is carried out, and the second corona charging is not carried out, no image can be obtained by application of an electric potential of the magnitude as described above.

The corona charging device 3 used in the first showering, the corona charging device 5 used in the second showering and the blocking electrode roller 6 may be travelled in the direction of the arrow 4 in a body or separately, since the travel of each corresponds to the respective steps in which they are used. Moreover, the injection electrode may be travelled, while the corona charging devices used in the first and the second showering, the blocking electrode roller and the light source are fixed at their respective positions and the injection electrode is travelled in the direction opposite to that of the arrow 4.

The base plate 11 of the injection electrode 1 may be made of glass or a transparent synthetic resin material, and an electrically conductive layer 12 of a transparent electrically conductive material such as tin oxide, indium oxide, copper, copper iodide, gold, palladium or the like is provided on the surface of the base plate 11. Generally, a suitable thickness for the transparent electrically conductive layer ranges about 50 A to about 5$\mu$. The electrically insulating layer 13 can be made of a transparent polymeric electrically insulating material having a specific resistivity higher than about $10^{10}$ ohm·cm, such as polystyrene, polyethylene, polypropylene, polyethylene terephthalate, polycarbonate and so on. A preferred thickness for the electrically insulating layer ranges from about 1 μm to about 200 μm. The electrically insulating layer 13 can be provided on the electrically conductive layer 12 by coating an electrically insulating resin as described above or by laminating an electrically insulating resin film thereon using an adhesive. However, it is not always necessary for the electrically insulating layer 13 and the electrically conductive layer 12 to be firmly held in a body on the base plate, and it is possible for the electrically insulating layer to be removable from the electrically conductive layer. The injection electrode of the above-described materials is shown in FIG. 1 in the form of a plate, but the form of the injection electrode is not intended to be construed as being limited to this plate form. Accordingly, any form; for example, a cylindrical form as described in British Pat. No. 1,331,622, may be employed.

Ink 2 is prepared by dispersing light-sensitive particles into an electrically insulating carrier liquid. Specific examples of materials which can be used for the light-sensitive particles, e.g., having a particle size of about 0.001 to about 10μ, include organic pigments such as phthalocyanine series pigments as disclosed in, for example, U.S. Pat. Nos. 3,357,989 and 3,594,163, etc., quinacridone series pigments as disclosed in, for example, U.S. Pat. Nos. 3,753,708 and 3,635,981, etc., azo series pigments as disclosed in, for example, British Pat. Nos. 1,146,142 and 1,217,905, etc., furanquinone series pigments, triphenylmethane series pigments, and so on; inorganic pigments such as ZnO, CdS, $TiO_2$ and the like; and organic photoconductive materials such as mixtures of charge transfer complexes prepared from poly-N-vinyl-carbazole and compounds capable of forming charge transfer complexes together with poly-N-vinylcarbazole with poly-N-vinylcarbazole. An appropriate amount of the light-sensitive particles dispersed in the electrically insulating carrier liquid can be about 0.05 to about 25% by weight, preferably 0.05 to 10% by weight, most preferably 0.1 to 5% by weight.

Specific examples of electrically insulating carrier liquids which can be used include kerosene, cyclohexane, long chain saturated aliphatic hydrocarbons and so on. A suitable specific resistance for the electrically insulating carrier liquid is about $10^{11}\Omega\cdot$cm or less, preferably $10^{12}\Omega\cdot$cm or less. A dispersion stabilizer as disclosed in, for example, U.S. Pat. No. 3,933,487, etc., an electric charge controlling agent, an antifogant as disclosed in, for example, U.S. Pat. No. 3,616,398, Netherlands Pat. No. 7,409,694, etc., a fixing agent as disclosed in, for example, Netherlands Pat. No. 7,404,284, etc. and a sensitizer as disclosed in, for example, U.S. Pat. No. 3,869,286, etc. may be optionally incorporated in ink 2, if desired.

The blocking electrode roller can be a metallic roller made of, for example, copper, brass, aluminum, stainless steel, duralumin or the like. In addition, a thin plate of a metal such as copper, brass, aluminum or the like may be wound around the above-described metallic roller so as to be easily detachable as the occasion-demands. In addition to such a metallic thin plate, an electrically insulating sheet such as baryta paper, a polystyrene sheet, a polypropylene sheet, a polyethylene terephthalate sheet, a polycarbonate sheet or the like may be also wound around the metallic roller. Furthermore, each of these thin plates or sheets can also be used in the form of long web, as disclosed in British Pat. No. 1,331,622. Such a long web itself can be employed as a practical blocking electrode by scanning the surface of the blocking electrode roller.

In addition, both the injection electrode and the blocking electrode, of course, can be used in the form of long web, as disclosed in, for example, U.S. Pat. No. 3,985,434 and Japanese Patent Publication No. 130223/76.

In the illustration as described above, the injection electrode was transparent. However, the present invention is not intended to be construed as being limited to this case, and it is apparent that the blocking electrode may be transparent and therefore, light-exposure may be carried out through the blocking electrode.

Image(s) formed on both or either the injection electrode and/or the blocking electrode in accordance with the above-described embodiments may be fixed thereon using conventional techniques, or the image(s) may be transferred onto the surface of another material.

Figure 2:
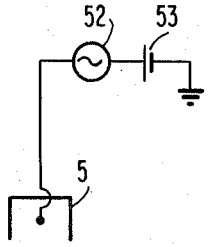
FIG. 2 and FIG. 3, each is another schematic cross-sectional diagram of a corona charging device which can be employed for the second corona showering, equipped in another apparatus used in carrying out the process of the present invention.

FIG. 2 is a schematic cross-sectional diagram of another embodiment of a corona charging device for generating corona ions for the second showering which is equipped in an apparatus useful in carrying out the present invention.

In FIG. 2, the corona electrode of the second corona charging device 5 is connected in series to an A.C. high voltage power supply 52 and a D.C. power supply 53. Due to the combined use of a source of A.C. potential and a source of D.C. potential, an A.C. and D.C.-superimposed voltage can be applied to the second corona electrode and therefore, the ratio of the quantity of positive corona ions generated to that of the negative ions generated can be controlled by appropriately choosing the value of the D.C. voltage supplied from the D.C. power supply 53. Consequently, electric charges held on the electrically insulating surface of the injection electrode can be more effectively reduced or eliminated. Specifically, connection in series of a D.C. power supply of 0 to ±2,000 volts to an A.C. power supply of 3 to 12 kilovolts can be effectively used.

The polarity of the D.C. power supply varies with the polarity of the corona ions first showered. The D.C. power supply 53 is preferably connected so that corona ions having the same polarity as the corona ions first showered are generated in a quantity slightly larger than that of the corona ions of the opposite polarity. However, the present invention is not to be construed as being limited to the above-described situation. The purpose will be served if only corona ions having the same polarity as the corona ions first showered are present as some portion of the corona ions second showered, or alternatively, it is effective under certain circumstances for corona ions having an opposite polarity to that of the corona ions first showered to be present in a smaller quantity therein.

Figure 3:
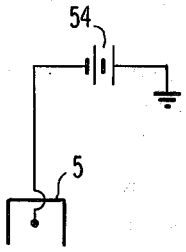

FIG. 3 is a schematic cross-sectional diagram of still another embodiment of a corona charging device for generating the corona ions for the second showering in an apparatus useful in carrying out the present invention.

In FIG. 3, the corona electrode of the corona charging device 5 used in the second showering is connected to a D.C. high voltage power supply 54. The polarity of the connected side of the D.C. high power supply is opposite to that of the corona ions first showered and, therefore, corona ions second showered having a polarity opposite to that of the corona ions first showered are generated therein. In this case, the corona ions second showered can reduce or eliminate the electric charges on the electrically insulating surface of the injection electrode and, at the same time, they may invert the polarity of the electric charge of the particles under certain circumstances. Accordingly, where the charging device shown in FIG. 3 is used, the charged particles must be showered with such a number of corona ions that the polarity of the charged particles can not be inverted. However, where the blocking electrode possesses a dark electric charge-injecting property, which can invert the polarity of the charged particles adhering thereto in an optically-unexposed area, which polarity is opposite to that of the corona ions first showered, and make the resulting particles migrate toward the injection electrode and, on the other hand, which can not re-invert the polarity of the charged particles in the optically exposed area, which is rendered the same as the first corona ions due to the inversion through exposure to light, or can only slightly re-invert their polarity, is employed, the charged particles may be showered with corona ions second showered of such a number that the polarity of the charged particles is inverted. Specific examples of such a blocking electrode include those which possess an electrically conductive or a semi-conductive surface. In addition, examples of blocking electrodes having a similar action to that described above include those made of a dark electric charge-injecting agent coated blocking electrode, as disclosed in Japanese Patent application (OPI) No. 82620/76, and blocking electrodes provided with a dark electric charge-exchanging material, as disclosed in Japanese Patent Application (OPI) No. 93431/75 (The term "OPI" as used herein refers to a "published unexamined Japanese patent application", hereinafter the same).

A voltage to be applied to the corona charging device 54 used in the second showering depends upon the amount of exposure of the corona ions first showered, and the distance between the corona charging device used in the second showering and the injection electrode. The voltage is, however, preferably selected such that it ranges from about 3.5 kilovolts to about 6 kilovolts.

The present invention will now be illustrated in greater detail by referring to the following examples.

EXAMPLE 1

An injection electrode was prepared by providing on a glass plate having a thickness of 2 mm in sequence a thin layer of tin oxide having a thickness of 10μ, and a polyethylene terephthalate film of a thickness of 25μ using a vinyl acetate bonding agent. An ink containing components in the following proportions was coated in a layer on the electrode so as to have a uniform overall thickness of 2μ.

| Ink Composition | parts by weight |
|---|---|
| Sumitone Cyanine Blue LBG (trade name of Sumitomo Chemical Co., Ltd. for C.I. Pigment Blue 15, C.I. 74160) | 1 |
| Isopar-H (trade name of Esso Standard Oil Co. for a petroleum solvent of isoparaffin series) | 100 |

The coated ink was subjected to a first corona showering using a D.C. corotron to which a D.C. voltage of +6 kilovolts was applied and sequentially, to a second corona showering using an A.C. corotron to which an A.C. voltage of 5 kilovolts, with a frequency of 50 Hz, was applied. Then, a blocking electrode roller made of brass, to which a D.C. voltage of +2.0 kilovolts was applied, was rolled over the surface of the injection electrode in face-to-face contact with the ink while simultaneously exposing the ink to an image-wise pattern of light. Thus, an image of good quality was obtained on the blocking electrode roller. On the other hand, no image could be formed when the second corona showering was omitted from the image-forming process described above.

EXAMPLE 2

An injection electrode was prepared in the same manner as in Example 1. An ink of components in the following amounts was coated in a layer in a substantially uniform thickness on the injection electrode.

| Ink Composition | parts by weight |
|---|---|
| Lyonogen Magenta R (trade name for a quinacridone series pigment manufactued by Toyo Ink Mfg. Co., Ltd.) | 0.5 |
| Kerosene | 100 |

The coated ink was subjected to a first corona showering using a D.C. corotron driven by a voltage of +5 kilovolts and sequentially, to a second corona showering using an A.C. corotron driven by an A.C. voltage of 5 kilovolts oscillating with a frequency of 50 Hz. Then, a blocking electrode roller made of brass, around which a baryta paper had been wound and then, to which a D.C. voltage of +3.5 kilovolts was applied, was rolled over the surface of the injection electrode while synchronizing a light-exposure thereof. Thus, an image of good quality was formed on the baryta paper.

Where the second corona showering was omitted from the above-described image-forming process, no image could be formed.

EXAMPLE 3

The injection electrode used was the same as in Example 1. An ink of the following components was coated in a layer of a substantially uniform thickness on the injection electrode.

| Ink Composition | parts by weight |
|---|---|
| Poly-N-vinylcarbazole | 0.2 |
| 2,4,7-Trinitro-9-fluorenone | 0.3 |
| Isopar-H (described in Example 1) | 100 |

The coated ink was subjected to a first corona showering using a D.C. corotron and a voltage of −5 kilovolts and sequentially, to a second corona showering as described in Example 1, followed rolling a blocking electrode roller made of brass, to which a D.C. voltage of −2 kilovolts was applied, over the injection electrode while simultaneously exposing the ink to an image-wise pattern of light. Thus, a good image was obtained.

EXAMPLE 4

The procedures as described in Example 1 were carried out except that the second corona showering was carried out using a corotron at a 5 kilovolt A.C. potential having a frequency of 50 Hz superimposed on a +500 volt D.C. potential. An image of good quality was also obtained.

EXAMPLE 5

The same procedures as described in Example 3 were carried out except that the second corona showering was carried out using a corotron at a D.C. potential of +4 kilovolts. A good image was also obtained.

As described in detail above, in accordance with various embodiments of the present invention, electric charges adhering on the surface of the injection electrode hardly exist even in a process comprising the steps of coating an ink on an injection electrode having an electrically insulating surface and of showering the charged particles in the ink with corona ions to force the electric sign of all of the charged particles to be the same, and an image of good quality can be formed even under conditions where the magnitude of the applied potential across the injection electrode-blocking electrode sandwich is comparatively small.

While the invention has been described in detail and with reference to specific embodiments thereof, it will be apparent to one skilled in the art that various changes and modifications can be made therein without departing from the spirit and scope thereof.

What is claimed is:

1. A photoelectrophoretic image-forming process using a pair of electrodes at least one of which is transparent and at least one of which has an electrically insulating surface, comprising the steps of:

(1) forming a liquid film of a suspension of light-sensitive particles on the electrically insulating surface of one of the electrodes as the first electrode, (2) in a first showering, showering the liquid film with corona ions of either polarity, (3) further showering the charged liquid film with corona ions containing corona ions of an polarity opposite to that of the corona ions of the first showering, (4) positioning the other of the two electrodes facing the first electrode with the liquid film therebetween, (5) image-wise exposing the liquid film to light through the transparent electrode while simultaneously applying an electric potential across both electrodes such that the polarity of the second electrode is the same as the polarity of corona ions in the first showering, and thereby causing optically-exposed light-sensitive particles in the liquid film to migrate from the first electrode onto the surface of the second electrode, resulting in the production of an image of the light-sensitive particles on at least one of the electrodes.

2. The process of claim 1, wherein the voltage applied to produce said corona ions in said first showering ranges from about 4 kV to about 8 kV, wherein said voltage applied to produce said corona ions in said further showering is an A.C. voltage of about 3 to about 12 kV with a frequency ranging from about 10 Hz to about 100 kHz and the electric potential applied across both electrodes simultaneously with said image-wise exposing of said liquid film ranges from about 300 volts to about 6,000 volts.

3. The process of claim 1, wherein said electrode which is transparent comprises a support of glass or a transparent synthetic resin material having thereon a transparent electrically conductive layer of a material selected from the group consisting of tin oxide, indium oxide, copper, copper iodide, gold and palladium and further having thereon a transparent electrically insulating layer of a polymeric electrically insulating material having a specific resistivity higher than about $10^{10}$ ohm.cm selected from group consisting of polystyrene, polyethylene, propylene, polyethylene terephthalate and polycarbonate.

4. The process of claim 1, wherein the electrically insulating surface of the electrode on which the liquid film of the suspension of light-sensitive particles is formed has a surface resistance of about $10^{12}$ Ω/square or higher.

5. The process of claim 1, wherein the injection electrode is transparent.

6. The process of claim 5, wherein the injection electrode comprises a transparent base plate, a grounded transparent electrically conductive layer and a transparent electrically insulating layer.

7. The process of claim 6, wherein the transparent base plate comprises a glass or a transparent synthetic resin material.

8. The process of claim 7, wherein the transparent electrically conductive layer comprises a material selected from the group consisting of tin oxide, indium oxide, copper, copper iodide, gold and palladium.

9. The process of claim 7, wherein the transparent electrically insulating layer comprises a polymeric electrically insulating material having a specific resistivity higher than about $10^{10}$ ohm:cm selected from group consisting of polystyrene, polyethylene, propylene, polyethylene terephthalate and polycarbonate.

10. The process of claim 1, wherein the liquid of the suspension of light-sensitive particles comprises kerosene, cyclohexane or a long chain saturated aliphatic hydrocarbon.

11. The process of claim 1, wherein the voltage applied to produce said corona ions in said first showering ranges from about 4 kV to about 8 kV.

12. The process of claim 1, wherein the second showering is carried out with corona ions containing both corona ions of a positive polarity and corona ions of a negative polarity.

13. The process of claim 12, wherein the second showering is carried out in the combined use of a source of A.C. potential and a source of D.C. potential.

14. The process of claim 12, wherein the AC voltage is in a range of about 3 kV to about 12 kV and has a frequency ranging from about 10 Hz to about 100 kHz.

15. The process of claim 1, wherein the second showering is carried out by connecting to a D.C. high power supply having a polarity opposite to that of the first corona ions.

16. The process of claim 1, wherein the blocking electrode is transparent.

17. The process of claim 1, wherein the blocking electrode is a metallic roller.

18. The process of claim 17, wherein the blocking electrode has provided thereon an easily detachable metallic thin plate.

19. The process of claim 1, wherein the blocking electrode is a metallic roller having provided thereon an easily detachable electrically insulating sheet.

20. The process of claim 1, wherein at least one of the blocking electrodes and the injection electrode are in the form of a long web.

21. The process of claim 1, wherein the electrical potential applied across both electrodes simultaneously with the image-wise exposing of the liquid film ranges from about 300 volts to about 6,000 volts.

* * * * *